US008783743B2

(12) United States Patent
Park et al.

(10) Patent No.: US 8,783,743 B2
(45) Date of Patent: Jul. 22, 2014

(54) OUTSIDE HANDLE ASSEMBLY OF VEHICLE

(75) Inventors: Hoo Sang Park, Hwaseong-si (KR); Sang Hoon Gweon, Seoul (KR); Suk Dong Park, Daegu (KR)

(73) Assignee: Hyundai Motor Company, Seoul (KR)

( * ) Notice: Subject to any disclaimer, the term of this patent is extended or adjusted under 35 U.S.C. 154(b) by 310 days.

(21) Appl. No.: 13/175,647

(22) Filed: Jul. 1, 2011

(65) Prior Publication Data

US 2012/0104774 A1 May 3, 2012

(30) Foreign Application Priority Data

Nov. 3, 2010 (KR) ..... 10-2010-0108712

(51) Int. Cl.
*E05B 3/00* (2006.01)
*E05B 1/00* (2006.01)

(52) U.S. Cl.
USPC ..... 292/336.3; 292/DIG. 53; 292/DIG. 54

(58) Field of Classification Search
USPC ..... 292/336.3, DIG. 53, DIG. 54
See application file for complete search history.

(56) References Cited

U.S. PATENT DOCUMENTS

| | | | | |
|---|---|---|---|---|
| 6,234,548 | B1 * | 5/2001 | Mittelbach et al. | 292/336.3 |
| 6,363,577 | B1 * | 4/2002 | Spitzley | 292/336.3 |
| 6,447,030 | B1 * | 9/2002 | Meinke | 292/347 |
| 6,464,270 | B1 * | 10/2002 | Sloan et al. | 292/336.3 |
| 6,554,331 | B2 * | 4/2003 | Ciborowski et al. | 292/347 |
| 6,565,134 | B1 * | 5/2003 | Stuart et al. | 292/336.3 |
| 6,575,508 | B2 * | 6/2003 | Stuart et al. | 292/336.3 |
| 6,594,861 | B2 * | 7/2003 | Dimig et al. | 16/412 |
| 6,672,633 | B2 * | 1/2004 | Nomura et al. | 292/336.3 |
| 6,719,336 | B2 * | 4/2004 | Sato | 292/336.3 |
| 6,749,236 | B2 * | 6/2004 | Nomura et al. | 292/336.3 |
| 7,344,168 | B2 * | 3/2008 | Matsubara et al. | 292/336.3 |
| 7,530,610 | B2 * | 5/2009 | Tanimoto et al. | 292/336.3 |
| 7,827,736 | B2 * | 11/2010 | Sunahara et al. | 49/503 |
| 8,128,137 | B2 * | 3/2012 | Takaya et al. | 292/336.3 |
| 8,282,142 | B2 * | 10/2012 | Fannon | 292/336.3 |
| 2003/0001399 | A1 * | 1/2003 | Sato | 292/336.3 |
| 2003/0011202 | A1 * | 1/2003 | Kwak | 292/336.3 |

FOREIGN PATENT DOCUMENTS

| | | | |
|---|---|---|---|
| JP | 8-35360 | A | 2/1996 |
| JP | 10-8790 | A | 1/1998 |
| JP | 2001-323689 | A | 11/2001 |
| KR | 10-2005-0092855 | A | 9/2005 |
| KR | 10-2008-0103022 | A | 11/2008 |

* cited by examiner

*Primary Examiner* — Carlos Lugo
(74) *Attorney, Agent, or Firm* — Morgan, Lewis & Bockius LLP

(57) ABSTRACT

An outside handle assembly of a vehicle includes a handle grip having a pivot end at one end thereof and an operating lever at the other end thereof, and a handle base located in a door panel and coupled to the handle grip that can be pulled by a user. Here, an initial setting lever is mounted at a rear side of the handle base. A balance weight mounted at the rear side of the handle base by the medium of a return spring is moved in an open direction to be hooked and locked by the initial setting lever. Also, the operating lever of the handle grip has a perpendicularly-bent end at the end thereof such that the operating lever is inserted into the handle base without an interference with the balance weight.

5 Claims, 9 Drawing Sheets

OUTSIDE HANDLE ASSEMBLY OF VEHICLE

CROSS-REFERENCE TO RELATED APPLICATION

This application claims under 35 U.S.C. §119(a) the benefit of Korean Patent Application No. 10-2010-0108712 filed Nov. 3, 2010, the entire contents of which application is incorporated herein for all purposes by this reference.

BACKGROUND

1. Technical Field

The present invention relates to an outside handle assembly of a vehicle. More particularly, it relates to an outside handle assembly of a vehicle, which can assemble a one-piece outside handle to a handle base without any interference with a weight balance.

2. Background Art

As well known, an outside handle assembly that is mounted in a door of a vehicle functions as an interface for a user to open and close the door of the vehicle.

The outside handle assemblies basically include an outside handle grip (hereinafter, referred to as a handle grip) that is exposed from the outer surface of a door panel and is actually manipulated by a user, and an outside handle base (hereinafter, referred to as a handle base) that is located inside the door panel and is coupled to the outside handle grip such that the handle grip can be pulled from the outside handle base.

As shown in FIGS. 5A through 5C showing an outside handle assembly according to a related art, a pivot shape part 12 is formed at an inner end of a handle grip 10, and a straight operating lever 14 is integrally formed at the other inner end of the handle grip 10. The pivot shape part 12 of the handle grip 10 is pivotably mounted on a lever shaft 22 at one side of a handle base 20. The operating lever 14 is inserted into a handle lever 24 at the other side of the handle base 20, and then is fastened with a mounting screw 26.

Also, a balance weight 30 is mounted at the rear side of the handle surface 20 pivotably by the medium of a return spring.

Accordingly, when the handle grip 10 is pulled, the handle lever 24 coupled to the operating 14 of the hand grip 10 using the mounting screw 26 is pulled, and at the same time, the balance weight 30 connected to the handle lever 24 is pivoted. Then, a cable connected to the balance weight 30 is pulled, and locking of a door latch assembly connected to the cable is released to open the door.

However, when an operating lever of a hand grip has a straight shape, there is a limitation in that fabrication workability of, for example, coupling of a mounting screw is reduced, and since a separate handle lever has to be mounted in a handle base to operate a balance weight, its assembly structure may be complicated.

In another example according to a related art, which has been proposed in consideration of such a limitation, an outside handle assembly as shown in FIGS. 6A and 6B includes an operating lever 14 that is perpendicularly bent. The operating lever 14 may be inserted into a handle base 20, and then may be coupled to a balance weight 30.

That is, the balance weight 30 is mounted at the rear side of the handle base 20 in advance. The balance weight 30 may be transferred by a center screw 32. The operating lever 14 of the handle grip 10 that is perpendicularly bent is inserted into the handle base 20, and then is rotated at its original position to allow the balance weight 30 to move along the thread of the center screw 32. In this case, a pullback lever 34 of the balance weight 30 is allowed to move up to an end bent part 16 of the operating lever 14.

Since the balance weight 30 is mounted by means of a return spring 36, the balance weight 30 is pivoted in a door open direction, and then is again pivoted to its original position according to the resilient force of the return spring 36.

Accordingly, when a handle grip 10 is pulled, the end portion of the operating lever 14 of the handle grip 10, that is, the bent part 16 pushes the pullback lever 34 of the balance weight 30 to be pivoted and thus allows the balance weight 30 to be pivoted. At the same time, a cable connected to the balance weight 30 is pulled to unlock the door latch assembly and open the door.

However, since the balance weight has to be horizontally transferred toward the operating lever of the handle grip through a manipulation of rotating the center screw, the fabrication workability may be reduced.

Accordingly, a simpler assembly structure in which an operating lever having a perpendicularly-bent shape is inserted without an interference with a balance weight and then the operating lever of a handle grip can be subsequently coupled to the balance weight is required.

The information disclosed in this Background section is only for enhancement of understanding of the general background of the invention and should not be taken as an acknowledgement or any form of suggestion that this information forms the prior art already known to a person skilled in the art.

SUMMARY

The present invention provides an outside handle assembly of a vehicle, in which an operating lever of a handle grip can be inserted into a handle base while easily avoiding an interference with a balance weight, and then the operating lever of the handle grip can be subsequently coupled to the balance weight as locking of an initial setting lever is released, by using the operating lever having a perpendicularly-bent shape, pivotably mounting the balance weight at the rear side of the handle base by means of a return spring, and fixing the balance weight to one end thereof while being pulled back in an opening direction by a locking action of the initial setting lever mounted at the rear side of the handle base.

In one aspect, the present invention provides an outside handle assembly of a vehicle comprising a handle grip comprising a pivot end at one end thereof and an operating lever at the other end thereof and a handle base located in a door panel and coupled to the handle grip that can be pulled by a user, wherein an initial setting lever is mounted at a rear side of the handle base, a balance weight mounted at the rear side of the handle base by the medium of a return spring is moved in an open direction to be hooked and locked by the initial setting lever, and the operating lever of the handle grip has a perpendicularly-bent end at the end thereof such that the operating lever is inserted into the handle base without an interference with the balance weight.

In various embodiments, a projecting part may be formed at a rear portion of the balance weight, and a locking hook for hooking the projecting part may be integrally and or monolithically formed at the initial setting lever.

In other embodiments, a pushing end may be integrally and/or monolithically formed at a rear side of the initial setting lever based on a location where a locking hook is formed.

In various embodiments, when the initial setting lever is unlocked, the balance weight may be pivoted to an original position by a resilient force of the return spring to allow a rear side of a pullback lever of the balance weight to be detachably hooked by an outer surface of a perpendicularly-bent end of the operating lever.

In other embodiments, a stopper contacting an outer surface of a bent end of the handle grip may be integrally and/or monolithically formed at an inner portion of the handle base to limit a forward pullback distance of the handle grip.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Figure 1:
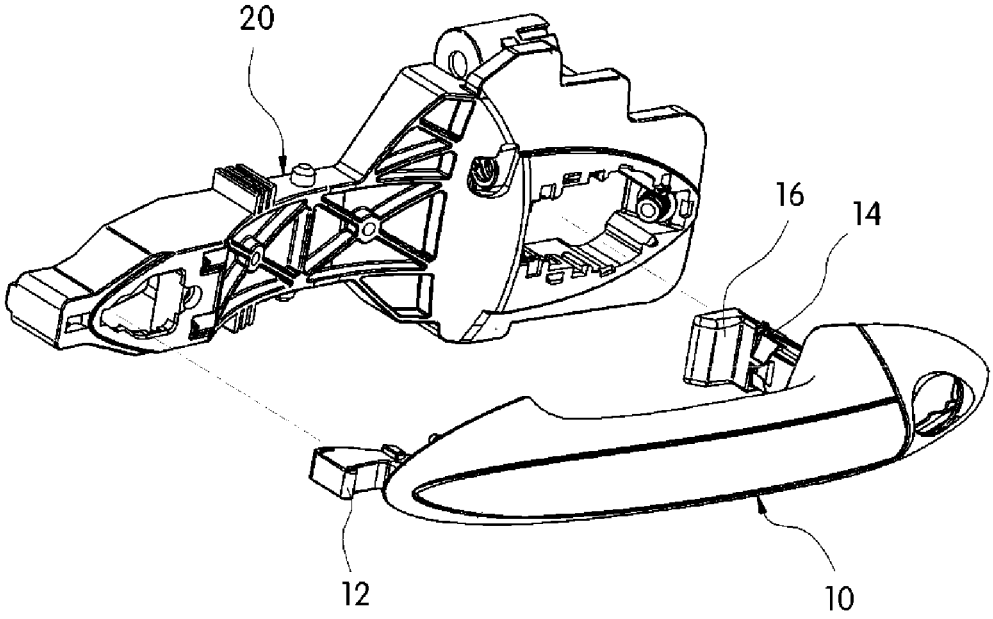
FIG. 1 is a view illustrating a handle grip specification of an exemplary outside handle assembly of a vehicle according to the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

As shown in FIG. 1, an outside handle assembly may include a handle grip 10 having a pivot end 12 formed at an inner end thereof and an operating lever 14 formed at the other inner end thereof, and a handle base 20 that is located inside a door panel and is coupled to the handle grip 10 that can be pulled.

Particularly, the operating lever 14 of the handle grip 10 may have a perpendicularly-bent shape. That is, the operating lever 14 may include a bent end 16 that is bent at the end portion thereof.

According to various embodiments, the operating lever 14 may be simply coupled to a balance weight 30 by easily inserting the operating lever 14 of the handle grip 10 into the handle base 20 such that the bent end 16 of the operating lever 14 is not interfered with the balance weight 30 that is mounted at the rear side of the handle base 20.

Figure 2:
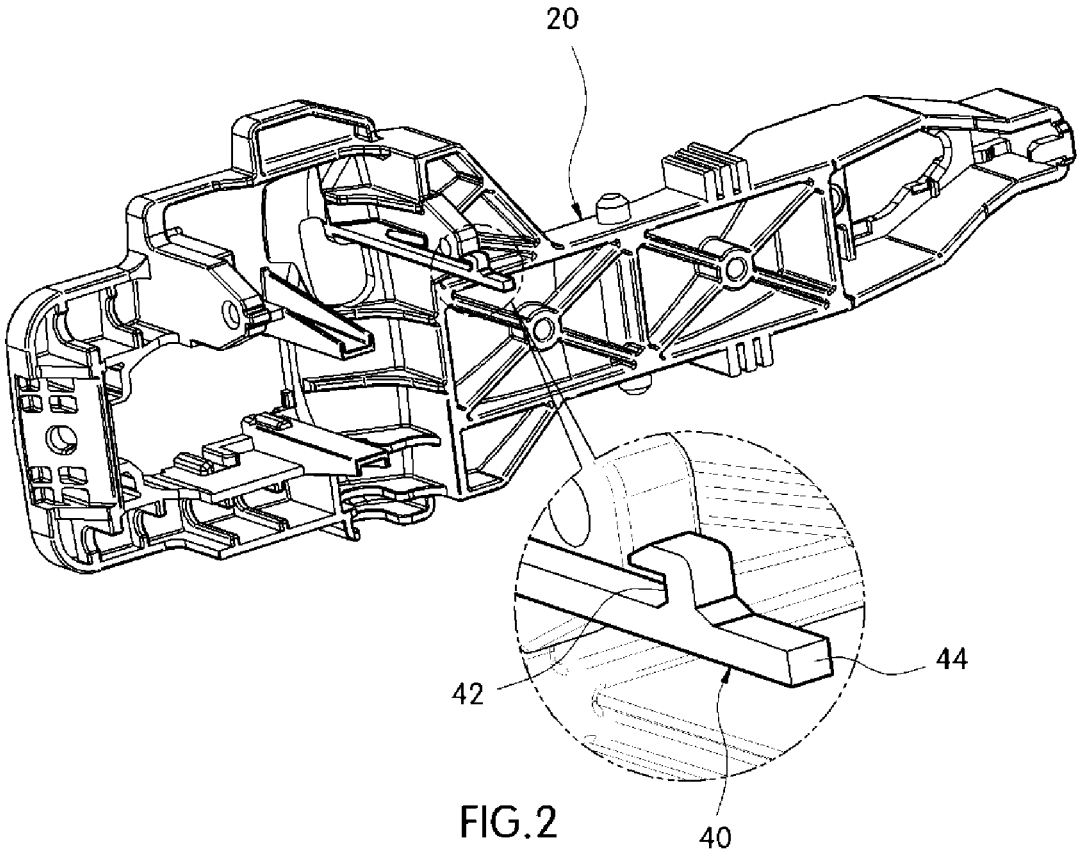
FIG. 2 is a perspective view illustrating an initial setting lever mounted at the rear side of a handle base of an exemplary outside handle assembly of a vehicle according to the present invention.

To this end, an initial setting lever 40 may be mounted at the rear side of the handle base 20 as shown in FIG. 2.

The initial setting lever 40, which has a pin shape with a certain length, may include a locking hook 42 protrusively formed at a certain location of the inner side thereof, and a pushing end 44 formed at the outer side thereof.

In this case, a balance weight 30 may be pivotably mounted at a certain location of the rear side of the handle base 20. A return spring 36 may be inserted into the pivot of the balance weight 30 to provide a resilient force that restores the balance weight 30 to the original position.

Also, the pullback lever 34 contacting the bent end 16 of the operating lever 14 may be formed at one end portion of the balance weight 30 about the pivot thereof, and a weight part 38 having a certain weight may be formed at the other end portion of the balance weight 30.

Particularly, a projecting part 46 may be formed between the weight part 38 and the pullback lever 34 at the rear side of the balance weight 30 to be hooked by the locking hook 42 of the initial setting lever 40.

On the other hand, a stopper 48 may be integrally and/or monolithically formed at the inside of the handle base 20 where the handle grip 10 is inserted. The stopper 48 may contact the bent end 16 of the handle grip 10 and serve to limit a forward pullback distance of the handle grip 10.

That is, when the handle grip 10 is pulled forward (opening direction), the outer surface of the bent end 16 of the handle grip 10 may contact the stopper 48 to limit the pullback of the handle grip 10. Accordingly, the stopper 48 may serve to easily prevent the handle grip 10 from being separated forward.

Figure 3:
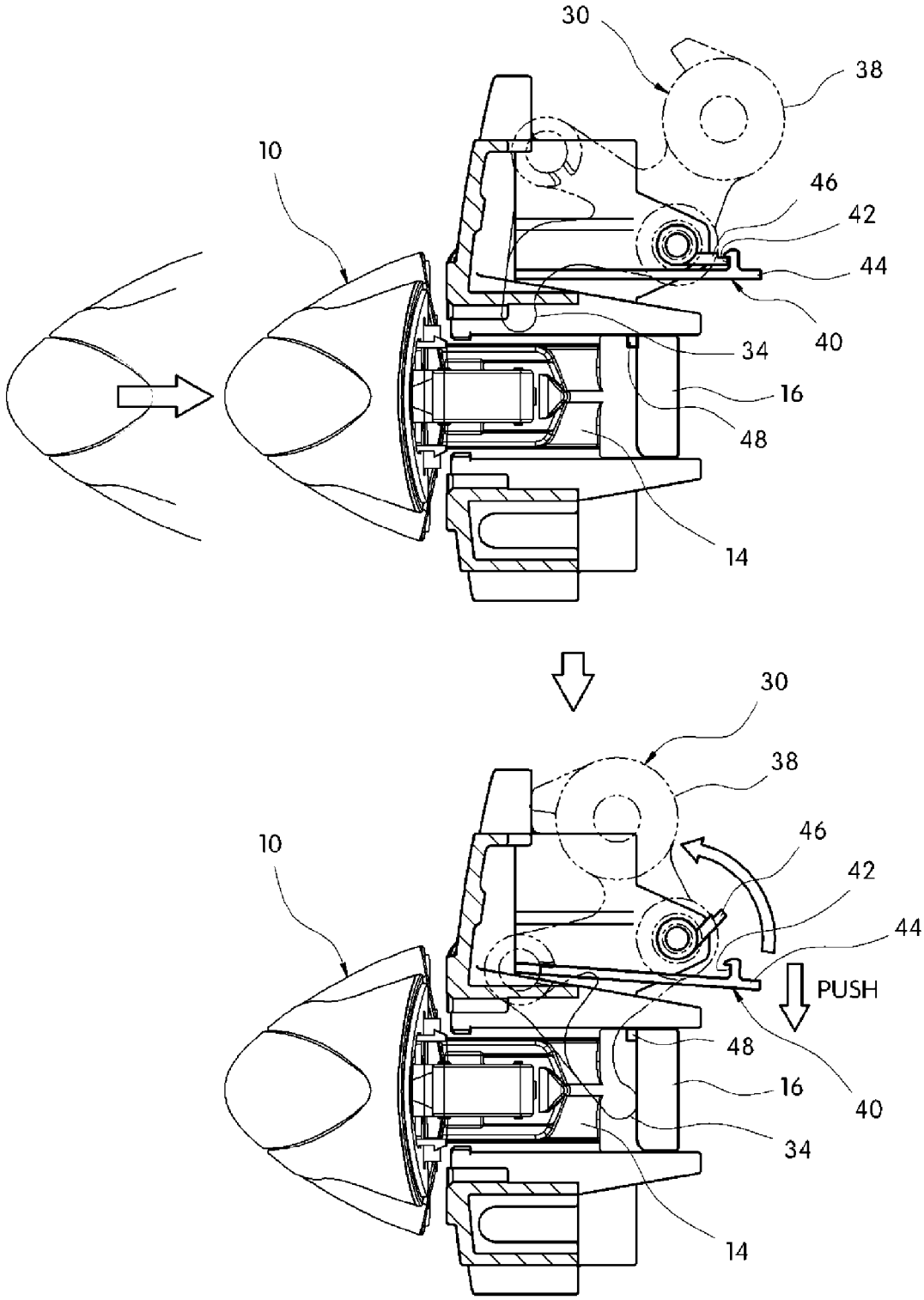
FIG. 3 is a side cross-sectional view illustrating an exemplary outside handle assembly of a vehicle according to the present invention, in which a handle grip is inserted into a handle base and is coupled to a balance weight in a state where the balance weight is fixed in an opening direction.

Hereinafter, a process of fabricating an outside handle assembly according to various embodiments will be described in detail with reference to FIG. 3. The process may include inserting a handle grip into a handle base and coupling it to a balance weight.

First, the balance weight 30 may be pulled back in the door open direction about the pivot of the balance weight 30, and at the same time, the locking hook 42 of the initial setting lever 40 may hook the projecting part 46 of the balance weight 30. Accordingly, the balance weight 30 may be locked by the initial setting lever 40 to maintain the state of being completely pulled back in the door open direction.

Next, the operating lever 14 of the handle grip 10 may be inserted into the inside of the handle grip 20. In this case, the pullback lever 34 of the balance weight 30 may be moved in the door open direction. Accordingly, the bent end 16 of the operating lever 14 may be easily inserted without an interference with the pullback lever 34 of the balance weight 30.

Next, when the pushing end 44 of the initial setting lever 40 is pushed, the locking hook 42 of the initial setting lever 40 may be separated from the projecting part 46, and at the same time, the balance weight 30 may be pivoted to the original position by the resilient force of the return spring 36.

If the balance weight 30 is pivoted to the original position by the resilient force of the return spring 36 together with the unlocking by the initial setting lever 40, the rear surface of the pullback lever 34 of the balance weight 30 may detachably contact the outer surface of the bent end 16 of the operating lever 14.

Accordingly, when the handle grip 10 is pulled back, the bent end 16 of the operating lever 14 may pull the pullback lever 34 of the balance weight 30, and at the same time, the balance weight 30 may be pivoted in the door open direction. As a result, a cable connected to the balance weight 30 is pulled to release the locking of the door latch assembly connected to the cable and open the door.

Figure 4:
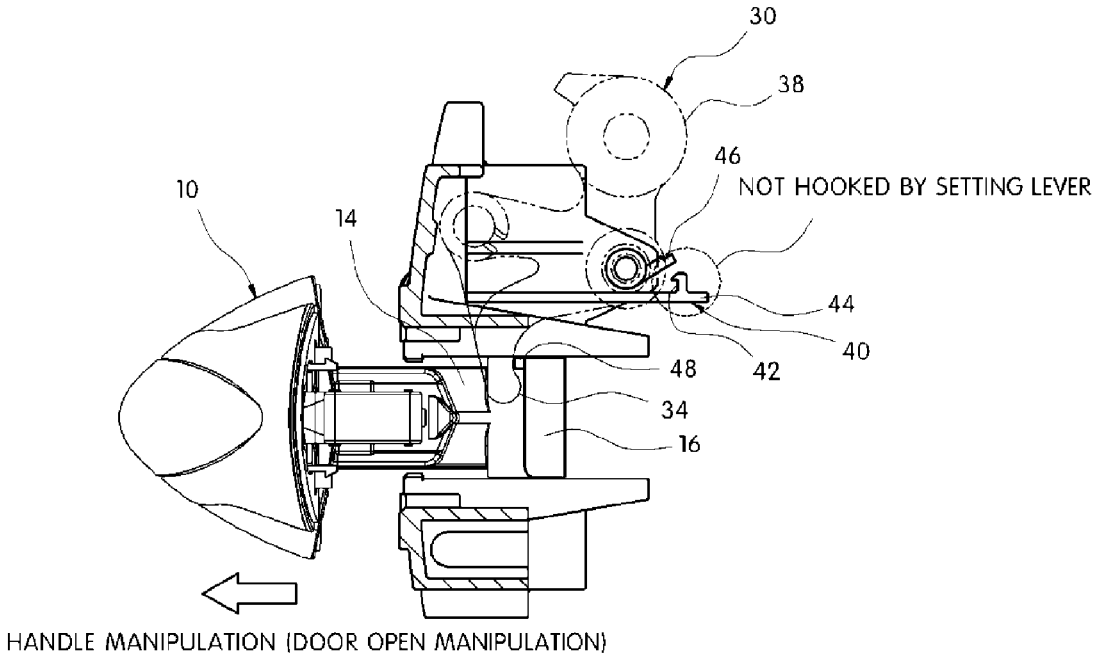
FIG. 4 is a side cross-sectional view illustrating an exemplary outside handle assembly of a vehicle according to the present invention, which shows an open operation of a handle grip after a balance weight is unlocked.
Figure 5A:
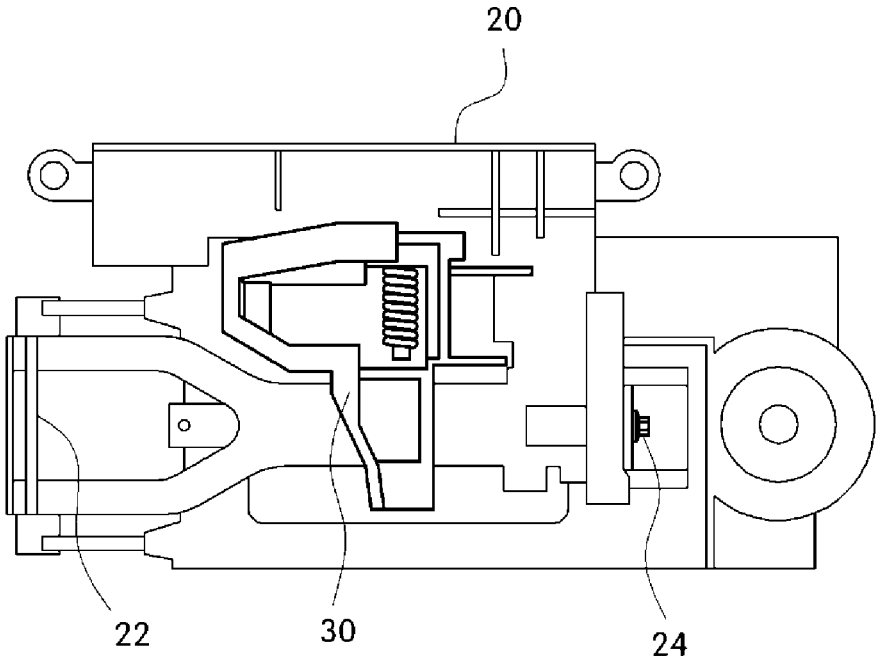
FIG.5a (Prior Art)
FIGS. 5A through 5C are views illustrating an exemplary outside handle assembly.
Figure 5B:
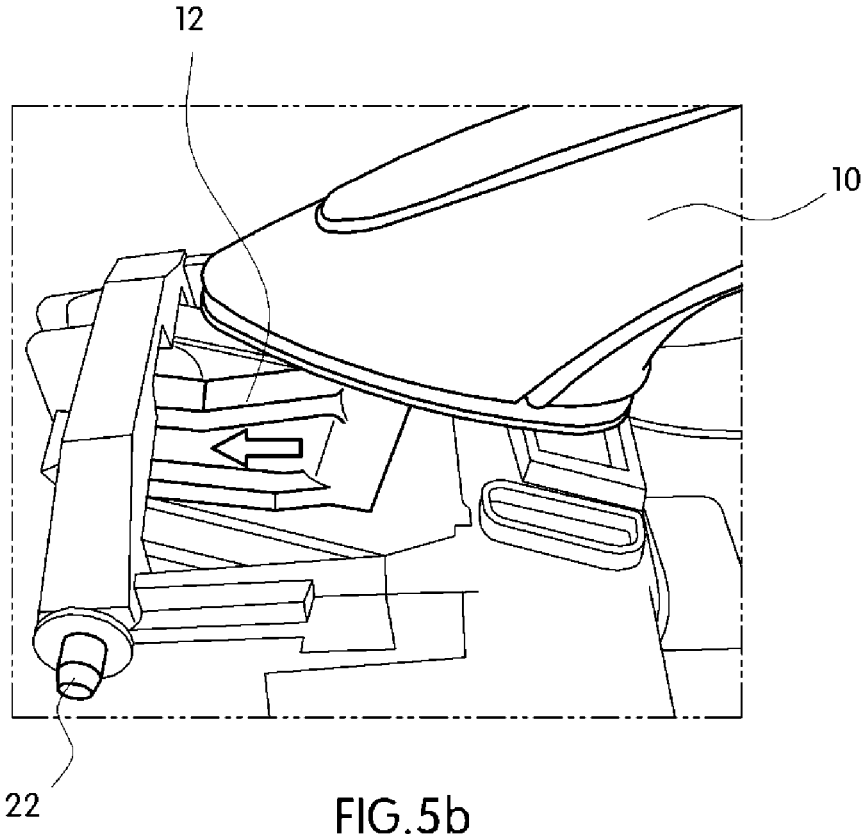
FIG.5b (Prior Art)
Figure 5C:
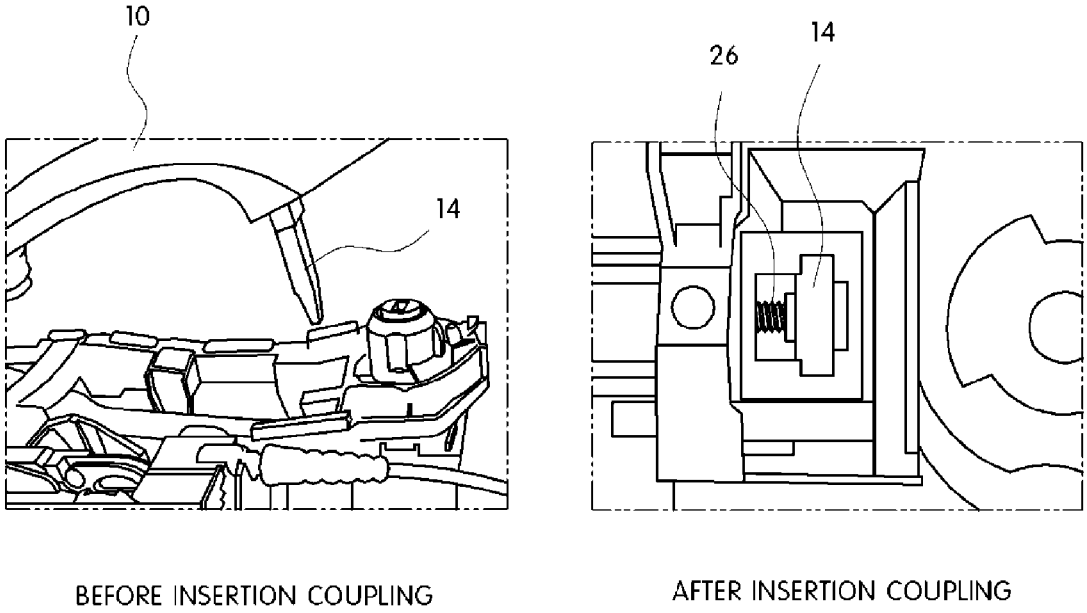
FIG.5c (Prior Art)
Figure 6A:
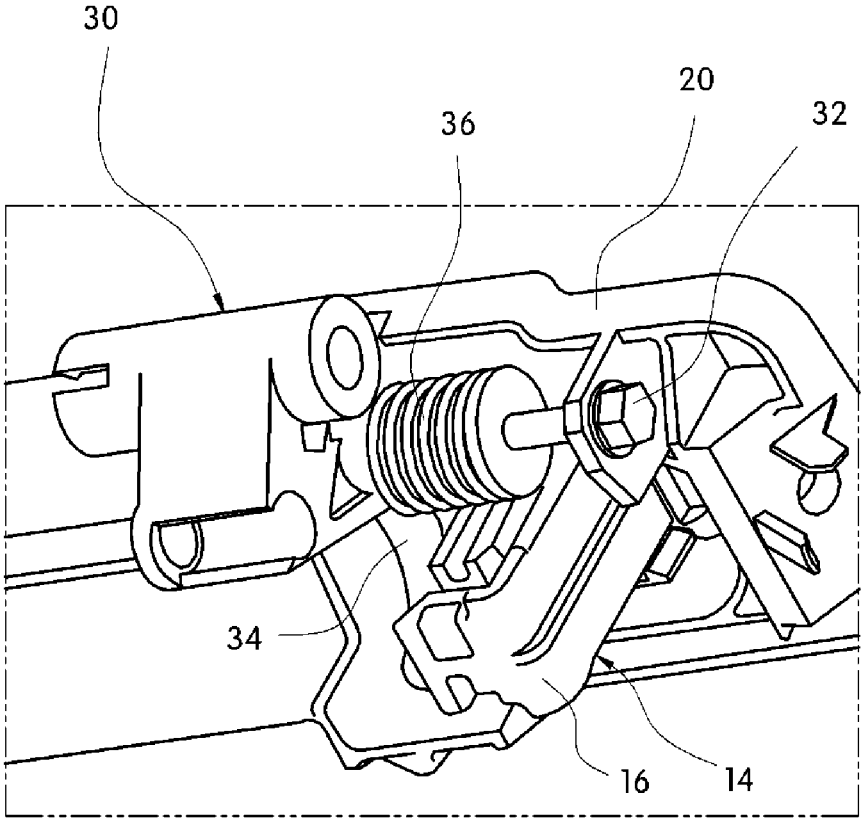
FIG.6a (Prior Art)
FIGS. 6A and 6B are views illustrating another exemplary outside handle assembly.
Figure 6B:
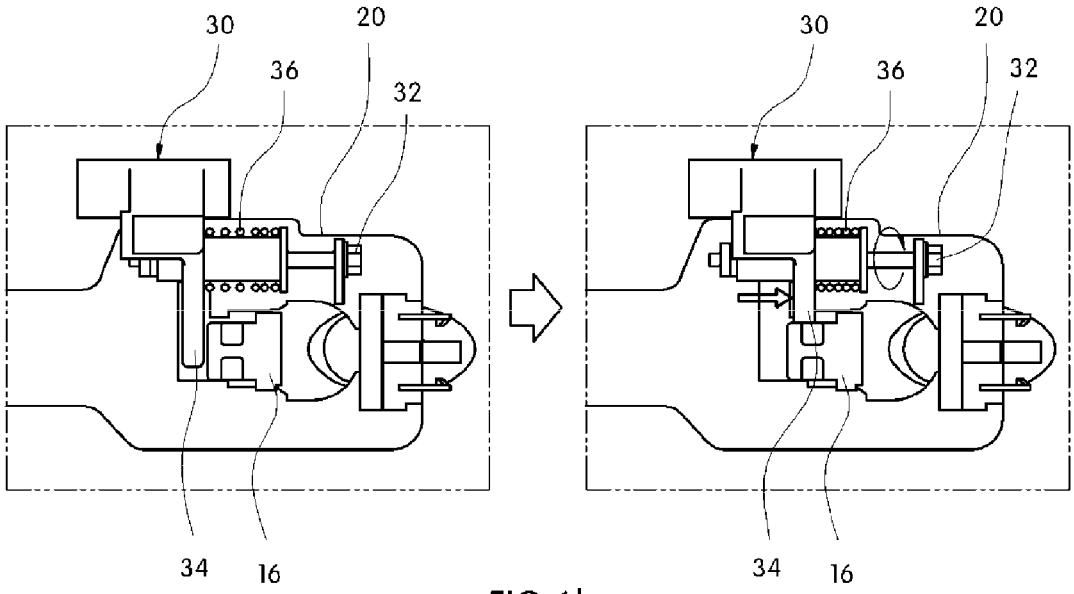
FIG.6b (Prior Art)

On the other hand, as shown in FIG. 4, since a rotation angle of the balance weight 30 in the door open direction by the bent end 16 of the operating lever 14 of the handle grip after the locking of the initial setting lever 40 is smaller than a rotation angle of the balance weight 30 in the door open direction by the initial setting lever 40 for locking, the balance weight 30 may not be again locked by the initial setting lever 40.

According to various embodiments of the present invention, an operating lever of a handle grip is formed to have a perpendicularly bent shape. A balance weight may be completely pulled back in an open direction and may be fixed by an initial setting lever, and then the operating lever of the handle grip may be easily inserted into the handle base while avoiding an interference with the balance weight. Accordingly, the fabrication structure of the handle grip can be simplified, and fabrication workability can be improved.

Also, only with an operation of pulling back the initial setting lever, the balance weight can be restored to the original position, and subsequent coupling with the operating lever of the handle grip can be easily achieved.

For convenience in explanation and accurate definition in the appended claims, the terms rear, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An outside handle assembly of a vehicle comprising:

a handle grip including a pivot end at one end thereof and an operating lever at the other end thereof; and a handle base located in a door panel and coupled to the handle grip that can be pulled by a user, wherein:

an initial setting lever is disposed at a rear side of the handle base;

a balance weight mounted at the rear side of the handle base and biased by a return spring toward an open direction to be hooked and locked by the initial setting lever; and the operating lever of the handle grip has a perpendicularly-bent end such that the operating lever is inserted into the handle base without an interference with the balance weight;

wherein a pushing end is integrally formed at a rear side of the initial setting lever; and wherein when the pushing end of the initial setting lever is pushed, the initial setting lever is separated from the balance weight.

2. The outside handle assembly of claim 1, wherein a projecting part is formed at a rear portion of the balance weight, and a locking hook for hooking the projecting part is integrally formed at the initial setting lever.

3. The outside handle assembly of claim 1, wherein the pushing end is integrally formed at a rear side of the initial setting lever based on a location where a locking hook is formed.

4. The outside handle assembly of claim 1, wherein, when the initial setting lever is unlocked, the balance weight is pivoted to an original position by a resilient force of the return spring to allow a rear side of a pullback lever of the balance weight to be detachably hooked by an outer surface of a perpendicularly-bent end of the operating lever.

5. The outside handle assembly of claim 1, wherein a stopper contacting an outer surface of a bent end of the handle grip is integrally formed at an inner portion of the handle base to limit a forward pullback distance of the handle grip.

* * * * *